United States Patent [19]

Wilder

[11] Patent Number: 4,465,209

[45] Date of Patent: Aug. 14, 1984

[54] INFORMATION CENTER FOR GASOLINE DISPENSING NOZZLE

[75] Inventor: Paul R. Wilder, Hamilton, Ohio

[73] Assignee: Dover Corporation, New York, N.Y.

[21] Appl. No.: 404,138

[22] Filed: Aug. 2, 1982

[51] Int. Cl.[3] ..... B67D 5/00

[52] U.S. Cl. ..... 222/23; 40/2 R; 222/173; 222/192

[58] Field of Search ..... 141/392, 94–96; 40/2 R, 310, 311, 331, 317, 5, 27.5, 306, 307, 312, 326, 489, 490; 215/230; 222/192, 173, 183, 23; 200/303, 333; 220/3.8

[56] References Cited

U.S. PATENT DOCUMENTS

| | | | |
|---|---|---|---|
| 436,799 | 9/1890 | McLaughlin | 40/317 |
| 2,800,931 | 7/1957 | Sutcliffe | 141/392 |
| 2,897,327 | 7/1959 | DeSmidt et al. | 200/303 |
| 2,951,619 | 9/1960 | Strumor | 40/311 |
| 3,391,694 | 7/1968 | Spaeth | 222/23 X |
| 3,860,771 | 1/1975 | Lynn et al. | 200/333 |
| 4,054,222 | 10/1977 | Syk | 220/3.8 |

FOREIGN PATENT DOCUMENTS

| | | | |
|---|---|---|---|
| 0278062 | 9/1914 | Fed. Rep. of Germany | 40/307 |

*Primary Examiner*—Stephen Marcus
*Assistant Examiner*—Mark Thronson
*Attorney, Agent, or Firm*—Kinney and Schenk

[57] ABSTRACT

An information center for gasoline dispensing nozzles utilizes a molded plastic disc having a top message surface and a central body portion which extends through a snug-fitting scuff guard of a gasoline nozzle. A flange about the lower surface of the disc entraps the disc between the scuff guard and the nozzle so that the disc is retained easily, without the need for fasteners or tools. Informative indicia is applied to the top exposed surface of the disc by means of pressure sensitive labels, silk screen printing, molded letters and logos, and the like.

12 Claims, 6 Drawing Figures

INFORMATION CENTER FOR GASOLINE DISPENSING NOZZLE

BACKGROUND OF THE INVENTION

In the field of commercial gasoline stations, it has been the practice in recent years to equip the gasoline dispensing nozzles at the pump site with a scuff guard, which is generally a close-fitting elastomeric jacket which is pulled over the nozzle to provide a comfortable hand grip for the nozzle user, and to provide a bumper surface to keep from nicking on the finish on vehicles with the nozzle as gas is dispensed. The scuff guard is usually formed of a soft plastic material such as vinyl, which may be easily injection molded, or dip-molded using a formed mandrel plunged into a vinyl plastisol, wherein the vinyl scuff guard may be then stripped from the mandrel for use on a nozzle. The vinyl compounds used for scuff guards are fairly impervious to gasoline and other contaminents encountered in the field, and may be easily replaced when damaged.

Heretofore, the necessity for information on a scuff guard surface was not generally a recognizable need, since most gas stations dispensed gas by means of their own help. However, in recent years since the public at large has begun dispensing their own gas, it has been felt that an opportunity to advertise at the nozzle site would be a desirable factor. Certain attempts at placing information on scuff guards has been attempted, such as silk screening, on the scuff guard surface, with a suitable paint. However, the printing is generally done where the broadest surface is presented, and the printed legend is easily damaged by continually banging and scratching of the scuff guard. Thus, the legend is easily destroyed, and presents an unattractive surface as well.

Applicant has studied the problem and has devised a means of providing an information center, which may be inexpensively applied to a scuff guard and nozzle, and which may be easily changed at the option of the user.

SUMMARY OF THE INVENTION

The invention is shown embodied in an information center for gasoline dispensing nozzles where an elastomeric jacket, commonly called a scuff guard, is sized to a snug fit with a gasoline dispensing nozzle. An aperture is provided through the elastomeric jacket which approximated the body portion of a information disc. The disc is a semi-rigid molded plastic disc having a raised circular body portion with the top end closed by faceted surfaces, and the bottom end of the hollowed disc is provided with a flange having a diameter larger than the body portion. The body portion of the disc is allowed to extend through the aperture of the scuff guard in assembly with a gasoline dispensing nozzle, and the disc is thus retained by the flange which will not readily pull through the scuff guard. Suitable information indicia such as a pressure sensitive lable is thereafter applied to the faceted exposed surface of the disc.

DESCRIPTION OF THE PREFERRED EMBODIMENT

Figure 1:
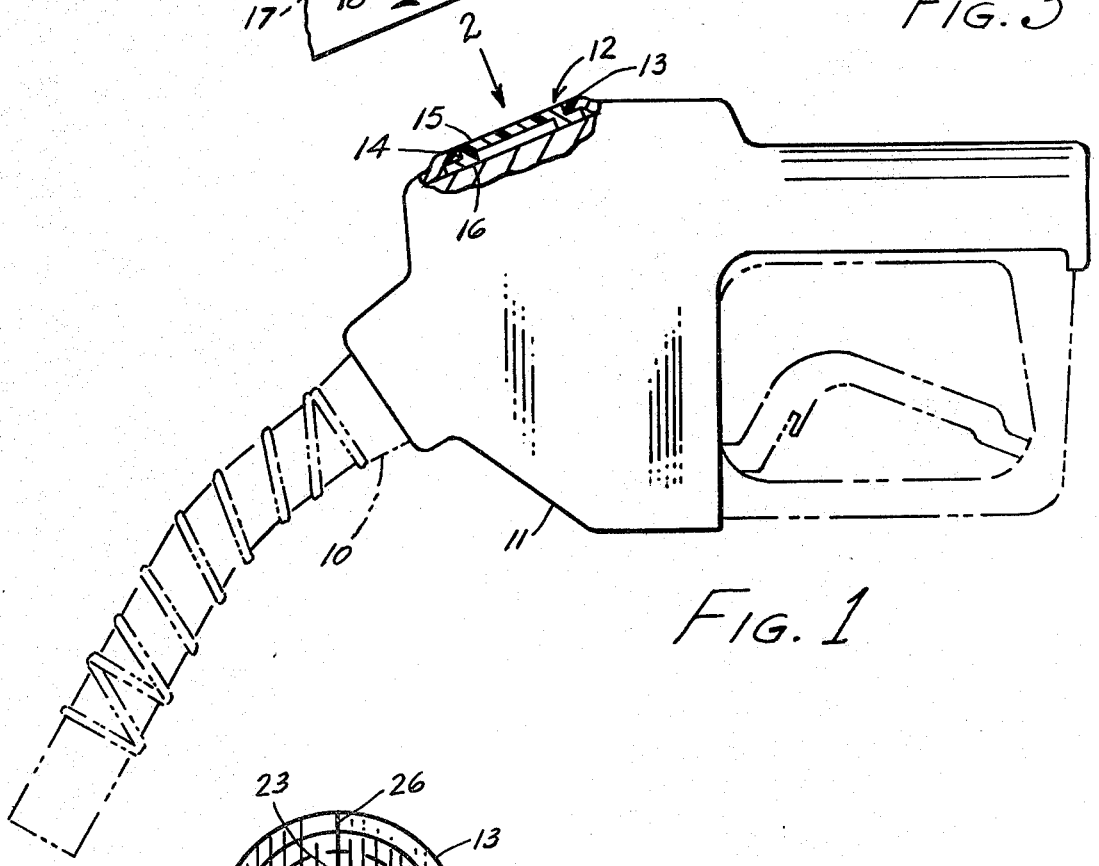
FIG. 1 is a side elevational view in partial section of a gasoline dispensing nozzle utilizing a information center.

Referring now to the drawings and particularly to FIG. 1 thereof there is shown a metal gasoline dispensing nozzle 10 commonly found in commercial gas stations, wherein nozzle 10 is fitted with a close-fitting elastomeric jacket, or scuff guard 11, which is generally molded from a vinyl compound having a rubbery feel. The scuff guard 11 is pulled over the end of gasoline dispensing nozzle 10, into tight engagement with the body of nozzle 10, to provide a comfortable hand grip for the user, and to serve to protect vehicle finishes from being damaged by the metal nozzle 10 in use.

The broken away portion of the top portion of scuff guard 11 (FIG. 1) illustrates an information center 12, comprising a molded semi-rigid plastic disc 13, which is entrapped between the scuff guard 11 and the top surfaces 19 and 20 of the metal nozzle 10. The disc 13 employed consists basically of a hollowed circular main body portion 14 having a closed upper end 15, and an open, flanged, lower end 16.

The elastomeric properties of the scuff guard serve to snugly entrap the disc against the nozzle while presenting the closed upper end to the view of the nozzle user.

Figure 2:
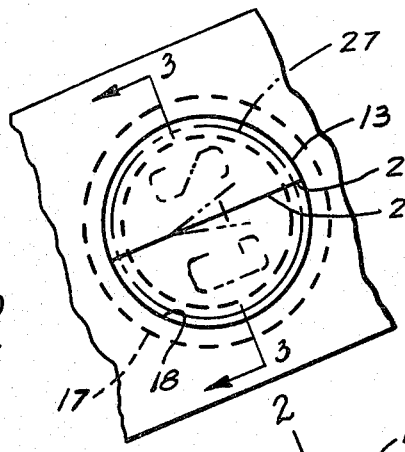
FIG. 2 is a plan view of the gasoline dispensing nozzle of FIG. 1 taken in the direction of arrow 2 of FIG. 1.

Referring to FIG. 2, the disc 13 of the preferred embodiment is of generally circular shape, having a larger circular flange 17 about the lower end 16. The circular main body portion 14 extends through an aperture 18 in the scuff guard 11, which may be either die cut or molded into the scuff guard 11.

Figure 3:
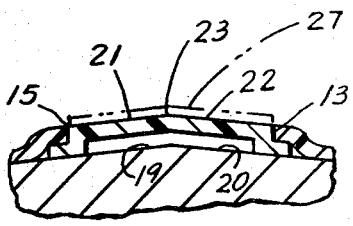
FIG. 3 is a cross sectional view through the information center of FIG. 2 taken along the lines 3—3 of FIG. 2.

FIGS. 2 and 3 show that the disc 13 has been shaped to generally conform to the angled top surfaces 19, 20 of the metal nozzle 10, but it may be appreciated that the nozzle 10 may have a flat surface and the designer may or may not wish to conform the closed upper end 15 to such a flat surface. The upper end 15 of the advertising disc 13 has been closed with integral semi-circular facet plates 21, 22, having an oblique included angle, which form a ridge 23 along the central diameter of the cylindrical body portion 14. The flange 17 of the disc 13 is formed of semi-circular flange plates 24, 25 joined at a ridge 26 as well, so as to be parallel to the facet plates 21, 22. It may appreciated from the general proportions of the drawing that it is preferable during the molding process, to form the disc 13 from a hollowed plastic material, preferably nylon, wherein the thickness of the flange 17 and upper plates 21, 22, and the wall thickness of the circular body portion 14 are uniform. Such a part may be easily injection molded in great quantities at low cost.

FIG. 2 illustrates that a pressure sensitive label 27 may be easily applied to the faceted upper end 15 of the disc 13 to convey a message. Similarly, the semi-rigid molded disc 13 may be permanently molded with any informative legend on its top surfaces or other types of indicia display may be used, for example, silk screen printing on the disc 13.

It is preferable that the upstanding walls of the circular main body portion 14 be substantially the same or higher than the thickness of the vinyl scuff guard 11, to more prominently display the information center 12 and to avoid the build up of dirt on the message surface.

Figure 4:
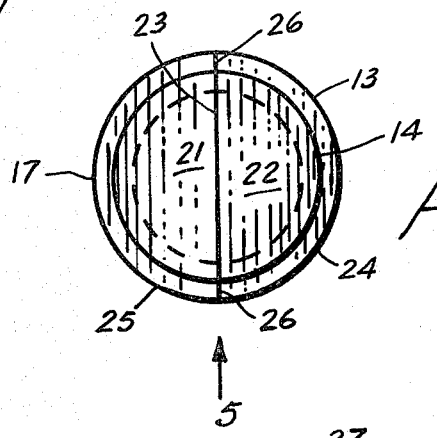
FIG. 4 is an enlarged plan view of the information center of FIG. 2.

Turning to FIG. 4, the disc 13 is shown as being generally circular in shape, having a ridge 23 formed along its main diameter by the top facet plates 21, 22 of the circular body portion 14. The ridge line is continued by the ridge 26 of the semi-circular flange plates 24, 25 at the bottom of the main body portion 14.

Figure 5:
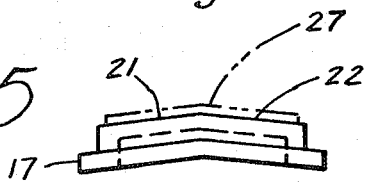
FIG. 5 is a front elevation of the information center of FIG. 4 taken in the direction of arrow 5 of FIG. 4.

FIG. 5 illustrates the angled-off facet plates 21, 22 which are adapted to conform to the top surface of the gasoline nozzle 10, and to provide some style to the design. However, it may be appreciated to those skilled in the art, that the disc 13 could be made with flattened top surface and flange, extending parallel to one another and at 90 degrees to the main body portion 14. Similarly, the flange 17 may be shaped to conform to a surface of a dispensing nozzle 10.

Figure 6:
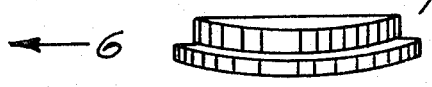
FIG. 6 is a side elevation of the information center of FIG. 4 taken in the direction of arrow 6 of FIG. 4.

FIG. 6 illustrates the disc 13 in side elevation.

It may be appreciated by those skilled in the art, that the disc 13 may be formed of many materials, although semi-rigid nylon makes an excellent, low cost, durable choice while providing a suitable surface to adhesively attach the pressure sensitive label 27. Further, it may be appreciated that the disc 13 need not be hollow as shown, but could be formed of a solid plastic, at the option of the user or molder, without materially effecting the display device.

With regard to information indicia, while it has been described in conjunction herewith that a pressure sensitive label 27 may be applied to the faceted top surfaces, it is contemplated that silk screen printing and permanent molding of raised letters, logos, and the like may also be utilized. Similarly, various colors may be employed where the object is to heighten the attraction of the display device to the user, as when a contrasting color is employed between the disc 13 and the scuff guard 11.

While the invention has been shown in conjunction with a preferred embodiment, it is intended that the invention not be limited to such embodiment, but rather extend to all such designs and modificaiton as come within the scope of the appended claims.

What is claimed is:

1. An information center, said center comprising:

a fluid dispensing nozzle, said nozzle having a top portion;

a disc, said disc having a main body portion, said disc having a bottom most integral flange, said flange being larger in diameter than said main body portion, said main body portion having a top most display surface;

an elastometric jacket, said jacket having inner and outer surfaces, said means being sized to fit said fluid dispensing nozzle, said jacket having an aperture formed therein, said aperture being approximately the size of said main body portion, said bottom most integral flange retaining said disc between said jacket and said top portion of said dispensing nozzle, said disc displaying information indicia.

2. The information center as recited in claim 1 wherein said main body portion has an opening, said opening being located at said lower end of said main body portion.

3. The information center as recited in claim 1 wherein said main body portion is substantially flush with said outer surface of said elastomeric jacket.

4. The information center as recited in claim 2 wherein said main body portion extends above said outer surface of said elastometric jacket.

5. The information center as recited in claim 1 wherein a first pressure sensitive label is applied to the top most display surface, said label displaying information indicia.

6. The information center as recited in claim 1, wherein silk screen print is applied to said top most display surface.

7. The information center as recited in claim 1, wherein permanent raised letters are molded into said top most display surface.

8. The information center as recited in claim 1 wherein said bottom most integral flange of said disc is easily removed from said position between said elastometric jacket and said top portion of said nozzle.

9. The information center as recited in claim 8 wherein a new disc is easily inserted into said aperture of said elastometric jacket after said disc is removed therefrom.

10. The information center as recited in claim 5 wherein a new label is superimposed over said first label, said second label displaying different information indicia than said first label.

11. The information center as recited in claim 10 wherein said second label displays the same information indicia as said first label.

12. An information center, said center comprising:

a dispensing nozzle, said nozzle having a top surface;

an elastometric jacket, said jacket having outer and inner surfaces, said inner surface of said jacket closely fitting about said nozzle, said jacket having an aperture connecting said outer and said inner surfaces;

a disc, said disc being entrapped between said jacket and said top surface of said nozzle, said disc further comprising:

a substantially circular main body portion, said portion having a closed upper end and an open, flanged lower end, said flange about said lower end is substantially larger than said main body portion, said lower flange being formed of semi-circular flange plates, said flange plates being joined at a first ridge, said upper end of said disc being closed with integral semi-circular facet plates, said facet plates having an oblique angle, said angle forming a second ridge, said second ridge extending along the central diameter of said main body portion, said first and said second ridges being substantially paraliel.

* * * * *

UNITED STATES PATENT AND TRADEMARK OFFICE

CERTIFICATE OF CORRECTION

PATENT NO. : 4,465,209

DATED : August 14, 1984

INVENTOR(S) : PAUL R. WILDER

It is certified that error appears in the above-identified patent and that said Letters Patent are hereby corrected as shown below:

In claim 1, line 56, delete "means" and substitute --jacket--.

Signed and Sealed this

*Eighteenth* Day of *December 1984*

[SEAL]

*Attest:*

GERALD J. MOSSINGHOFF

*Attesting Officer*

*Commissioner of Patents and Trademarks*